United States Patent [19]

Warner et al.

[11] B 3,981,364

[45] Sept. 21, 1976

[54] WELL TUBING PARAFFIN CUTTING APPARATUS AND METHOD OF OPERATION

[75] Inventors: Darrell G. Warner, New Orleans; William D. Loth, Covington, both of La.

[73] Assignee: Exxon Production Research Company, Houston, Tex.

[22] Filed: Oct. 2, 1974

[21] Appl. No.: 511,156

[44] Published under the second Trial Voluntary Protest Program on January 27, 1976 as document No. B 511,156.

[52] U.S. Cl. ..... 166/311; 166/174; 166/226; 166/315

[51] Int. Cl.[2] ..... E21B 21/00; E21B 37/02

[58] Field of Search ..... 166/166, 167, 168, 170, 166/172–176, 226, 311, 315

[56] References Cited

UNITED STATES PATENTS

| | | | |
|---|---|---|---|
| 2,117,836 | 5/1938 | Brown | 166/173 |
| 2,205,739 | 6/1940 | Wilson | 166/173 |
| 2,636,565 | 4/1953 | Williams | 166/170 |
| 2,720,925 | 10/1955 | Lynch | 166/176 |
| 2,825,411 | 3/1958 | Keltner | 166/173 |
| 2,981,331 | 4/1961 | Arterbury | 166/311 |
| 3,016,094 | 1/1962 | Abbott | 166/226 |
| 3,072,194 | 1/1963 | Winders | 166/170 |
| 3,376,936 | 4/1968 | Tomlin | 166/226 |
| 3,394,763 | 7/1968 | Page | 166/311 |
| 3,791,445 | 2/1974 | True | 166/224 A |

*Primary Examiner*—Ernest R. Purser
*Assistant Examiner*—Jack E. Ebel
*Attorney, Agent, or Firm*—John S. Schneider

[57] ABSTRACT

Apparatus for use in removing paraffin from a well tubing string above a wireline operated subsurface safety valve assembly installed in the tubing string and its method of operation. The safety valve assembly controls the flow of production oil and/or gas fluids through the tubing string. During normal production operations a wireline connects the paraffin cutting apparatus to surface facilities which include apparatus for maintaining sufficient tension on the wireline to hold the safety valve assembly in open position and for releasing tension on the wireline to permit the safety valve assembly to close. The paraffin cutter apparatus contains means for releasably connecting it to the safety valve assembly. Manipulation of the wireline actuates means on the paraffin cutting apparatus to open an equalizer port in the tubing string. Paraffin cut from the tubing string wall is removed by flow of production fluids through the open equalizer port. Further manipulation of the wireline actuates means on the paraffin cutting apparatus to release the paraffin cutting apparatus from the safety valve assembly and position the paraffin cutting knives or burrs for removal of paraffin from the wall of the tubing string as the paraffin cutting apparatus is withdrawn from the tubing string by means of the wireline.

16 Claims, 12 Drawing Figures

112
72
97
15
107
71
110
111
105
106
115
36
37
104
103
102
95
109
101
108
96
98
125
91
92
93
94
86
121
7
99
100
90
87
70
80
75
81
88
82
41
83
40
84
85
89

WELL TUBING PARAFFIN CUTTING APPARATUS AND METHOD OF OPERATION

BACKGROUND OF THE INVENTION

One desirable type of apparatus for assuring well safety in the production of oil and/or gas is the use of a downhole valve in a well tubing which is actuated by a tensioned wireline extending to the earth's surface. Routine paraffin removal in wells fitted with such a wireline safety valve assembly is a troublesome operation. The invention described herein simplifies any paraffin removal operation by storing a paraffin cutter immediately above the wireline operated subsurface safety valve and then cutting paraffin as the wireline used for valve actuation is removed from the well. The principle of operation is that as the safety valve assembly operating wireline is removed an equalizing port is opened, a paraffin cutting device is exposed and removed from the well with a single operation. Thus, at least one wireline trip for the operation is eliminated.

SUMMARY OF THE INVENTION

A paraffin cutter method and apparatus for removing paraffin from a well tubing string which contains a wireline operated subsurface safety valve. Means are provided for releasably connecting the paraffin cutter apparatus to the subsurface safety valve and means are also provided to permit opening of the subsurface safety valve by applying tension to the wireline without disconnecting the paraffin cutter apparatus from the subsurface safety valve. Means may be provided for retaining the cutting knives or burrs of the paraffin cutter apparatus retracted from the tubing string until the paraffin cutter apparatus is moved upwardly through the tubing string. In addition, means are provided for opening an equalizer port to permit production fluids to flow upwardly through the tubing string as the paraffin cutter apparatus is removed from the tubing string.

DESCRIPTION OF THE PREFERRED EMBODIMENTS

Figure 1:
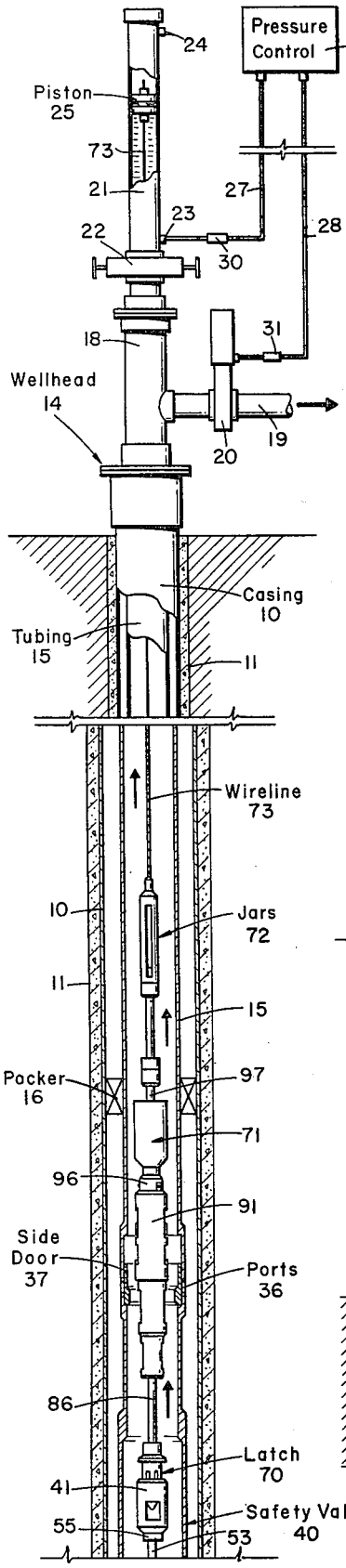
FIGS. 1 and 1A illustrate the paraffin cutting apparatus of the invention connected to a wireline operated subsurface safety valve positioned in a well production tubing or pipe string.
Figure 2:
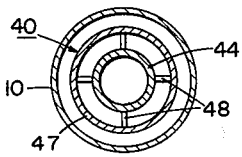
FIG. 2 is a view taken on lines 2—2 of FIG. 1A.
Figure 1A:
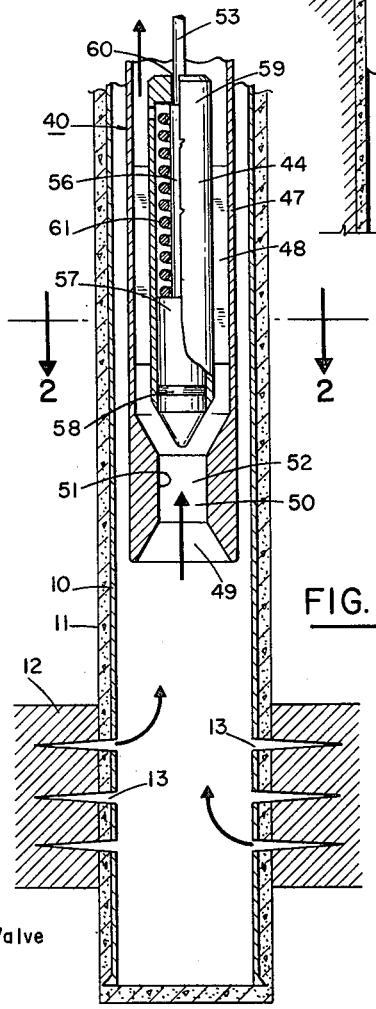

Referring to FIGS. 1 and 1A a well casing pipe 10 is shown cemented in a borehole 11. Casing pipe 10 penetrated a subsurface formation 12 which is, along with casing pipe 10, perforated as at 13. The casing pipe supports a surface wellhead assembly 14 and a well production tubing or pipe string 15. A packer 16 seals the annulus between the casing pipe 10 and tubing string 15. A christmas tree 18 mounted on wellhead 14 is provided with a flowline 19 containing a wing valve 20.

A lubricator tube 21 is connected to the upper end of tree assembly 18. Lubricator 21 is provided with a wireline sealing means 22 and a vent opening 24 at the upper end of lubricator 21. A piston 25 is slidably arranged in lubricator 21 above sealing means 22. A source of control fluid under pressure, indicated at 26, is connected by conduit 27 to inlet connection 23 to supply hydraulic pressure to the underside of piston 25. A conduit 28 is connected to a control for hydraulically-openable and spring-closable wing valve 20. Hydraulic pressure from control source 26 maintains valve 20 in its opened position. Heat sensitive connectors 30 and 31 are provided in conduit 27 and 28, respectively, to open those conduits to the atmosphere to release fluid pressure in lubricator 21 below piston 25.

A subsurface safety valve assembly, generally designated 40, of the type shown and described in U.S. Pat. No. 3,791,445 issued Feb. 12, 1974 to Martin E. True, entitled "Wireline Operated Safety Valve System," is positioned in the lower end of tubing string 15 and is locked, not shown, into tubing string 15. The safety valve assembly 40 may be run with tubing string 15 or may be run and locked into tubing string 15 after running tubing string 15. A latching collar 41 is located on the upper end of rod 53 at the upper end of valve assembly 40. Spaced apart concentric tubular members 44 and 47 are connected together by webbing members 48. A flowpath 49 indicated by the arrowed lines, is provided through valve inlet 52 and the space formed between tubular members 44 and 47. The lower end of tubular member 44 has a reduced inside diameter section wall 51 which forms a sealing bore 50. Rod member 53 extends through an opening 60 in the upper end 59 of tubular member 44. A stop collar 55 is formed on rod 53 at latching collar 41 to limit downward movement of rod 53 by engagement with the upper end 59 of tubular member 44. A lower portion 56 of rod 53 is larger in diameter than the upper portion thereof and is connected to a still further enlarged-in-diameter cylindrical valve element 57 at its lower end. The lower outer periphery of valve element 57 is provided with a seal ring 58. That seal ring is within tubular member 47 in the open position of the safety valve shown in FIG. 1A. A compression spring 61 urges valve element 57 downwardly to the closed position of the safety valve. Valve element 57 remains withdrawn within tubular member 47 so long as sufficient upward force is applied to rod 53.

Latch collar 41 is connected to a latch 70, which forms the lower end of the paraffin cutting system, generally designated 71. That system includes jars 72 which are attached to a wireline 73 which in turn extends to the earth's surface and is connected to piston 25. Tubing string 15 contains a nipple provided with an equalizer port 36 and a side door sleeve closure 37 therefor. The paraffin cutting system 71 is shown in more detail in FIGS. 3–9 inclusive to which reference is now made. Latch 70 includes a collar 80 having a stop shoulder 81 engagable with the uppermost surface 82 of safety valve collar 41 and collets or fingers 83 having tapered surfaces 84 which engage tapered surfaces 85 of collar 41. Latch 70 is initially connected by shear pin 75 (shown sheared) to a rod or shaft 86 which contains a pin slot 87, spring biased latches 88 and a latch expander section 89. Latch 70 contains a shear pin 90 past which rod 86 has limited movement provided by pin slot 87. Rod 86 extends upwardly through the lower end of a slotted outer sleeve 91. The upper end of rod 86 forms a piston 92. A coil spring 93 surrounds rod 86 within the lower end of outer sleeve 91 to urge rod 86 and piston 92 upwardly. A piston stop shoulder 94 is formed on sleeve 91. A plurality of sleeve actuator dogs 95, retained and supported by outer sleeve 91 and a slotted inner sleeve 96, surround an inner shaft 97 which contains spring biased latch pins 98 (see FIG. 7) which ride in keyways 99 formed on inner sleeve 96 and latch into locking recesses 100. The lugs 125 on inner sleeve 96 move in the lower slots formed in outer sleeve 91 and engage the underside of the dog retainer portion 101 of outer sleeve 91 when moved upwardly by upward movement of shaft 97. Springs 102 are attached to outer sleeve 96 and function to urge dogs 95 inwardly. Outer sleeve 96 also contains shear pins 103, which initially engage the underside of the uppermost section 104 of outer sleeve 91, an outer sleeve retainer 115, a shear pin 105, which extends across a slotted portion 106 of shaft 97, and an upper container portion 107.

Shaft 97 has an enlarged lower end 108 and contains bow springs 109 for urging dogs 95 outwardly. The upper end of shaft 97 contains a collar 110 on which burrs 111 are mounted. The uppermost end 112 of shaft 97 is connected to jars 72 to which is attached wireline 73.

OPERATION

Referring particularly to FIGS. 1, 1A, 2, 3 and 3A, the paraffin cutting apparatus 71 is connected to jars 72 and lowered on wireline 73 through tubing string 15 until latch 70 or the lower end thereof engages latching collar 41 on the upper end of subsurface safety valve 40.

Figures 3, 3A, 4, 5, 6, 7, 8:
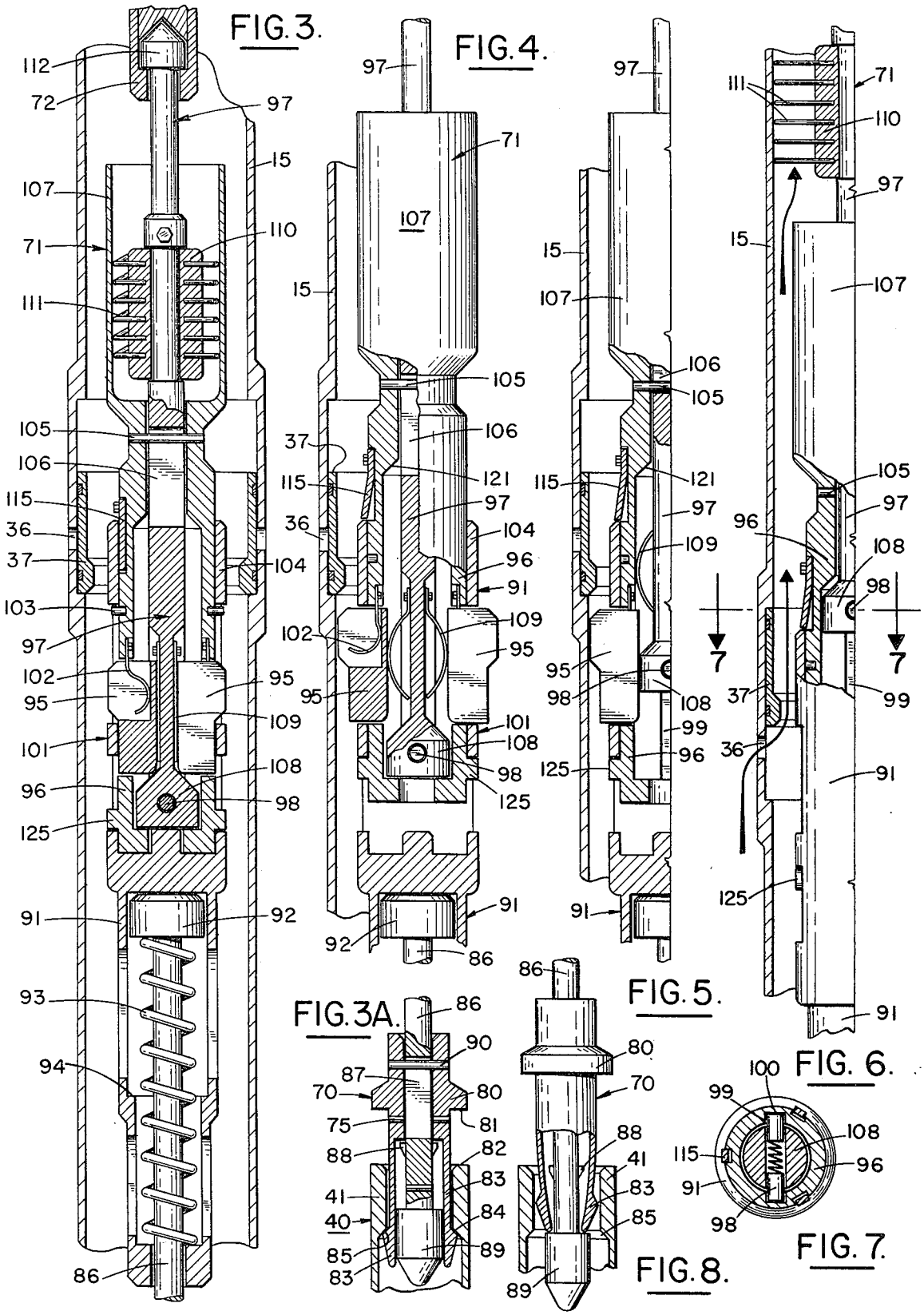
FIGS. 3 and 3A illustrate details of the paraffin cutting apparatus in one position thereof.
FIGS. 4, 5 and 6 illustrate a part of the paraffin cutting apparatus shown in FIG. 4 in various positions thereof.
FIG. 7 is a view taken along lines 7—7 of FIG. 6.
FIG. 8 illustrates the lower end of the paraffin cutting apparatus released from the upper end of the subsurface safety valve for removal of the paraffin scraper apparatus.

Collets or fingers 83 are retracted during lowering of paraffin cutting apparatus 71 through tubing string 15 sufficiently to enter the opening in latch collar 41. Shear pin 75 before being sheared, retains shaft 86 in its raised position in which the lower end of slot 87 is positioned adjacent shear pin 90 to permit collets or fingers 83 to enter safety valve assembly 40. In that position of shaft 86 spring latches 88 thereon would be retracted within the bore of latch 70. Once latch 70 is located within latch collar 41 manipulation of the wireline to cause sharp downward movement of the paraffin cutter apparatus causes stop shoulder 81 to strike surface 82 and shear shear pin 75. Latch expander 89 is then free to move downwardly and force collets 83 outwardly to engage locking surfaces 84 of the collets and 85 on latch collar 41. Spring latches 88 move outwardly and prevent movement of shaft 86 upwardly relative to latch 70 as shown in FIG. 3A.

As the paraffin cutter apparatus 71 is run in tubing string 15 on wireline 73 wireline seal 22 in lubricator 21 is open. Once latch 70 has latched into latch collar 41 piston 25 is attached to wireline 73. Seal 22 is closed on wireline 73 and hydraulic pressure from source 26 is supplied through conduit 27 and inlet 23 to the underside of piston 25 moving piston 25 upwardly in lubricator 21 and applying thereby a tensional force to wireline 73. The upward force on wireline 73 causes rod 53 and valve element 57 to move upwardly against the bias of spring 61 to retract valve element 57 into tubular member 47 and open bore 50 of tubular member 44 to open the safety valve to its full open position shown in FIG. 1A. Opening of the valve is accomplished by the tensional force in the wireline being applied to rod 53 through jars 72, shaft 97, dogs 95, inner sleeve 96, shear pins 103, outer sleeve 91, spring 93, rod 86, latch 70 and latch collar 41. The upward force on outer sleeve 91 required to compress spring 93 is less than the upward force on rod 53 required to compress spring 61 in safety valve 40. Thus, the safety valve is in its closed position when the components of the paraffin cutter are in the relative positions shown in FIGS. 3 and 3A. When the tensional force sufficient to open safety valve 40 is applied to wireline 73 shaft 97, inner sleeve 96 and outer sleeve 91 move upwardly against the bias of spring 93 until the underside of piston 92 engages or abuts piston stop 94 on outer sleeve 91. Additional upward force on wireline 73 moves piston 92 and rod 86 attached to it upwardly resulting in compression of spring 61 and safety valve 40 to move valve element 57 to its full open position as illustrated in FIG. 1A. Tension is maintained by the surface equipment. A predetermined tensional force is maintained on wireline 73 by fluid pressure supplied from source 26 to maintain bore 50 open. Hydraulic fluid is also supplied through conduit 28 to wing valve 20 which is a hydraulically opened-spring closed valve to maintain valve 20 in the open position. Well fluids flow from formation 12 through open safety valve 40, tubing string 15 and flowline 19. Loss of fluid pressure from lubricator tube 21 below piston 25 releases the tensional force on wireline 23 and, through paraffin scraper apparatus 71, permits spring 61 to move rod 53 and valve element 57 downwardly to seal and close bore 50. While connectors 30 and 31 in conduits 27 and 28 are described as heat sensitive in that they dissolve or disintegrate under a high temperature to cause release of fluid pressure from lubrication tube 21 and wing valve 20 and the resulting closure of the subsurface valve assembly and the wing valve, other connector devices sensitive to, for example, increased pressure of impact might be used to cause release of fluid pressure.

With tension maintained on wireline 23 the valve is in normal open flow condition. Upward movement of shaft 97 is prevented by sleeve actuator dogs 95 which engage the enlarged lower end 108 of shaft 97. Dogs 95 are held in place by dog retainer portion 101 of outer sleeve 91.

Figure 9:
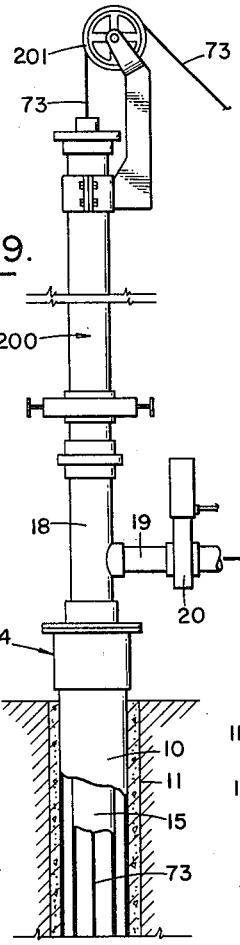
FIGS. 9 and 9A illustrate the paraffin cutting apparatus of the invention in operation as the paraffin cutter apparatus, disengaged from the subsurface safety valve, is removed from the production pipe string.

When it is desired to remove paraffin from the wall of tubing string 15 wireline seal 22 is opened and wireline 73 is disconnected from piston 25. Piston-cylinder assembly 21, 25 and pressure control apparatus 26, 27, 28 and 30 are replaced by the lubricator assembly 200 which includes the pulley 201 over which wireline 73 is run to a power reel as shown in FIG. 9. Wireline 73 is then slackened sufficiently to reduce upward force on outer sleeve 91 sufficiently to permit spring 93 to return it to its initial position (FIG. 3) which in turn reduces the upward force on rod 53 sufficiently to permit spring 61 to force valve element 57 to move downwardly and close bore 50. Wireline 73 is then jarred upwardly to cause shear pins 103 connected to inner sleeve 96 to shear. An upward pull on wireline 73 moves inner sleeve 96 upwardly relative to outer sleeve 91 until lugs 125 on inner sleeve 96 engage dog retainer portion 101 of outer sleeve 91 as seen in FIG. 4. Such upward movement of inner sleeve 96 causes dogs 95 to be moved outwardly toward the wall of tubing string 15 in the slots of outer sleeve 91 under the bias of leaf springs 109.

An additional upward pull on wireline 73 moves shaft 97 upwardly relative to inner and outer sleeves 96 and 91, respectively, until the lower end of pin slot 106 on shaft 97 engages pin 105 as illustrated in FIG. 5. During this movement the enlarged end 108 of shaft 97 moves within dogs 95 and acts as a back-up to hold dogs 95 in their full outwardly extending positions. Such movement also positions the lower surface of slot 106 of shaft 97 adjacent shear pin 105.

Additional upward pull on wireline 73 then raises shaft 97, inner sleeve 96 and actuator dogs together until dogs 95 engage the lower end of side door sleeve 37. Wireline 73 is then raised quickly and dogs 95 open side door sleeve 37. As side door sleeve 37 fully opens the sudden impact on shaft 97 jars the lower surface of slot 106 against shear pin 105 to cause it to shear and permit shaft 97 to move to its uppermost position where it engages stop shoulder 121 formed on inner sleeve 96 as shown in FIG. 6. When shear pins 103 were sheared and inner sleeve 96 moved upwardly relative to outer sleeve 91 sleeve retainer member 115 was freed of its retention by outer sleeve 91 and moved outwardly to prevent movement of outer sleeve 91 upwardly relative to inner sleeve 96.

Spring-biased locking pins 98 travel in keyways 99 formed in the inner wall of inner sleeve 96 when shaft 97 moves upwardly relative to inner sleeve 96 to prevent rotation of shaft 97 relative to inner sleeve 96. In the uppermost position of inner shaft 97 locking pins engage locking slots 100 as seen in FIG. 7 to prevent further movement of shaft 97 relative to inner sleeve 96.

The uppermost movement of shaft 97 relative to inner sleeve 96 moves scrapers or burrs 111 out of container 107 to permit the burrs to engage the wall of tubing string 15 as shown in FIG. 6.

Movement of the paraffin cutter apparatus 71 relative to the fixed stationary safety valve 40 attached to it is permitted by the lost motion movement of the lower end of outer sleeve 91 along shaft 86.

Figure 9A:
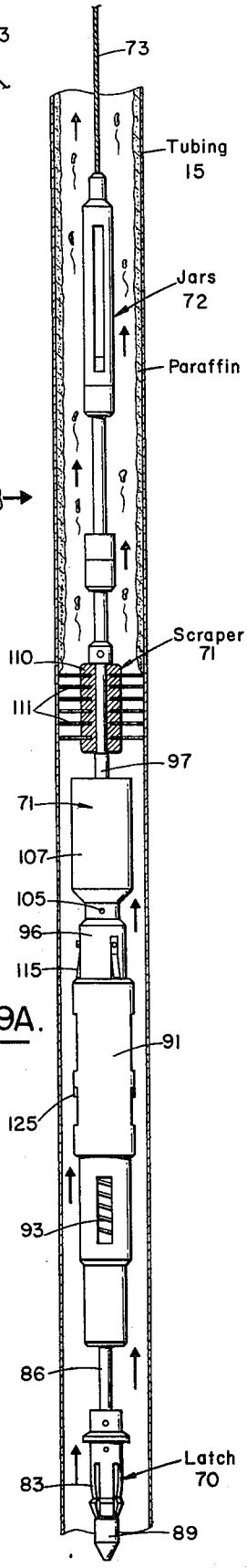

Wireline 73 is again slackened until shoulder 81 of latch 70 engages upper surface 82 of safety valve latch collar 41 to cause shear pin 90 to shear and permit rod 86 to move downwardly until latch expander 89 is below latch fingers or collets 83 as shown in FIG. 8. Latch fingers or collets 83 retract and the surfaces 84 and 85 of the latch and latch collar respectively disengage. Latch 70 is then removable from latch collar 41. The paraffin cutter 71 is then raised vertically for paraffin cutting in tubing 15 as indicated in FIGS. 9 and 9A. The safety valve 40 is closed and well flow is upwardly through the open side ports 36 and through tubing string 15 as indicated by the arrows in FIG. 9A to assist in paraffin removal.

Changes and modifications may be made in the illustrative embodiment of the invention shown and described herein without departing from the scope of the invention as defined in the appended claims.

Having fully described the apparatus, operation, objects and advantages of our invention we claim:

1. A paraffin cutter for use in removing paraffin from a well tubing comprising a stationary wireline operated subsurface safety valve;

means for releasably connecting said paraffin cutter to said subsurface safety valve and for permitting sufficient tension to be applied to said subsurface safety valve to maintain said subsurface safety valve open while said paraffin cutter and said subsurface safety valve remain connected together.

2. A paraffin cutter as recited in claim 1 including:

an equalizer port in said tubing;

closure means for said equalizer port; and means on said paraffin cutter for moving said closure means to open said equalizer port upon manipulation of said wireline and movement of said paraffin cutter.

3. A paraffin cutter as recited in claim 2 including:

means for cutting paraffin from said tubing; and means for retaining said cutting means retracted from cutting position until said paraffin cutter is released from connection to said safety valve.

4. A paraffin cutter apparatus for use in removing paraffin from a well tubing comprising:

a wireline operated subsurface safety valve arranged in said tubing;

releasable latch means for releasably connecting said paraffin cutter to said safety valve;

a slotted outer sleeve;

a first shaft having one end extending into the lower end of said outer sleeve and the other end thereof connected to said releasable latch means;

a spring surrounding said first shaft within said outer sleeve biasing said outer sleeve downwardly;

a slotted inner sleeve arranged within said outer sleeve;

the upper end of said inner sleeve forming a container;

a second shaft arranged within said inner sleeve and connected to said wireline at its upper end and having scraper burrs mounted thereon initially retracted within said container;

a port formed in said tubing;

a door initially closing off flow of fluids through said port;

door actuator dogs for engaging said door to open said port;

biasing means on said second shaft for urging said dogs outwardly into position to engage said door;

frangible means initially preventing upward movement of said inner sleeve relative to said outer sleeve; and means initially permitting but limited upward movement of said second shaft relative to said inner sleeve.

5. Apparatus as recited in claim 4 including means connected to said inner sleeve for urging said dogs inwardly.

6. Apparatus as recited in claim 5 in which said means initially preventing upward movement of said inner sleeve relative to said outer sleeve comprises a shear pin on said inner sleeve engaging said outer sleeve.

7. Apparatus as recited in claim 6 in which said means initially preventing but limited upward movement of said second shaft relative to said inner sleeve comprises a slot formed in said second shaft and a shear pin in said inner sleeve extended across said slot.

8. Apparatus as recited in claim 7 in which said second shaft contains an enlarged lower end for maintaining said dogs in position for engaging said door.

9. A method for cutting paraffin from a tubing containing a wireline operated subsurface safety valve comprising the steps of lowering paraffin cutting apparatus through said tubing on a wireline;

connecting said paraffin cutting apparatus to said safety valve;

applying sufficient tension to said wireline to maintain said safety valve open;

manipulating said wireline to disconnect said paraffin cutting apparatus from said safety valve; further manipulating said wireline to expose cutting elements on said paraffin cutting apparatus; and pulling said paraffin cutting apparatus upwardly through said tubing by said wireline.

10. A method as recited in claim 9 in which prior to raising said paraffin cutting apparatus upwardly through said tubing to remove paraffin from said tubing opening an equalizer port in said tubing to permit flow of production fluids upwardly through said tubing.

11. A method for cutting paraffin from a tubing containing a wireline operated subsurface safety valve comprising the steps of:

lowering paraffin cutting apparatus containing cutting elements engageable with the wall of said tubing through said tubing on a wireline;

connecting said paraffin cutting apparatus to said safety valve;

applying sufficient tension to said wireline to open said safety valve and maintain said safety valve open;

manipulating said wireline to disconnect said paraffin cutting apparatus from said safety valve and to expose cutting elements on said paraffin cutting apparatus for engagement with the wall of said tubing; and pulling said paraffin cutting apparatus upwardly through said tubing by said wireline with said cutting elements in engagement with the wall of said tubing.

12. A method as recited in claim 11 in which prior to raising said paraffin cutting apparatus upwardly through said tubing to remove paraffin from said tubing, opening an equalizer port in said tubing above the level of said safety valve to permit flow of production fluids upwardly through said tubing, said safety valve closing to prevent flow of fluids therethrough when disconnected from said paraffin cutting apparatus.

13. An elongated paraffin cutter apparatus for use in removing paraffin from a well tubing in which a wireline operated subsurface safety valve is arranged comprising:

releasable latch means capable of releasably connecting said paraffin cutter to said safety valve;

a slotted outer sleeve;

a first shaft having one end extending into one end of said outer sleeve and the other end thereof connected to said releasable latch means;

a spring surrounding said first shaft within said outer sleeve biasing said outer sleeve in one longitudinal direction;

a slotted inner sleeve arranged within said outer sleeve;

one end of said inner sleeve forming a container;

a second shaft arranged within said outer sleeve and having scraper burrs mounted thereon initially retracted within said container;

a port formed in said tubing;

a door initially closing off flow of fluids through said port;

door actuator dogs for engaging said door to open said port;

biasing means on said second shaft for urging said dogs outwardly into position to engage said door;

frangible means initially preventing longitudinal movement of said inner sleeve relative to said outer sleeve; and means, including a slot formed in said second shaft and a shear pin in said inner sleeve extending across said slot, initially permitting but limited longitudinal movement of said second shaft relative to said inner sleeve.

14. Apparatus as recited in claim 13 including means connected to said inner sleeve for urging said dogs inwardly.

15. Apparatus as recited in claim 14 in which said means initially preventing movement of said inner sleeve relative to said outer sleeve comprises a shear pin on said inner sleeve engaging said outer sleeve.

16. Apparatus as recited in claim 15 in which said second shaft contains an enlarged end for maintaining said dogs in position for engaging said door.

* * * * *